US008844278B2

(12) United States Patent
Tevis et al.

(10) Patent No.: US 8,844,278 B2
(45) Date of Patent: Sep. 30, 2014

(54) SYSTEM AND METHOD FOR CONTROLLING AN ELECTRO-HYDRAULIC CHARGING SYSTEM

(75) Inventors: Ethan M. Tevis, Bloomington, IL (US); Maureen E. Beck, Secor, IL (US); Shawn I. Cullen, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 959 days.

(21) Appl. No.: 12/967,611

(22) Filed: Dec. 14, 2010

(65) Prior Publication Data

US 2011/0146261 A1 Jun. 23, 2011

Related U.S. Application Data

(60) Provisional application No. 61/289,452, filed on Dec. 23, 2009.

(51) Int. Cl.

| | |
|---|---|
| ***F15B 11/00*** | (2006.01) |
| ***E02F 9/20*** | (2006.01) |
| ***E02F 9/22*** | (2006.01) |
| ***F15B 1/02*** | (2006.01) |

(52) U.S. Cl.

CPC ..... *F15B 1/024* (2013.01); *F15B 2211/4053* (2013.01); *F15B 2211/633* (2013.01); *F15B 2211/6306* (2013.01); *E02F 9/2025* (2013.01); *E02F 9/2246* (2013.01); *F15B 2211/665* (2013.01); *F15B 2211/625* (2013.01); *F15B 2211/426* (2013.01); *F15B 2211/7142* (2013.01)

USPC ..... 60/431; 60/418; 60/456

(58) Field of Classification Search

USPC ..... 60/416, 418, 431, 456

See application file for complete search history.

(56) References Cited

U.S. PATENT DOCUMENTS

| | | | | |
|---|---|---|---|---|
| 4,079,806 | A | 3/1978 | Hoag et al. | |
| 4,959,962 | A | 10/1990 | Hagen et al. | |
| 5,317,870 | A * | 6/1994 | Inagawa | 60/418 |
| 5,489,007 | A | 2/1996 | Yesel | |
| 5,944,159 | A * | 8/1999 | Schneider et al. | 192/85.63 |
| 6,436,005 | B1 | 8/2002 | Bellinger | |
| 6,681,568 | B2 * | 1/2004 | Smith | 60/422 |
| 6,702,401 | B2 | 3/2004 | Sherriff | |
| 6,920,387 | B2 * | 7/2005 | Landes et al. | 701/102 |
| 7,240,486 | B2 * | 7/2007 | Huang et al. | 60/413 |
| 7,322,800 | B2 | 1/2008 | Roth | |
| 7,469,535 | B2 * | 12/2008 | Sawada | 60/433 |
| 2007/0215406 | A1 | 9/2007 | McDonald et al. | |
| 2007/0227135 | A1 | 10/2007 | Khalil | |

FOREIGN PATENT DOCUMENTS

| | | |
|---|---|---|
| EP | 136384 | 4/1985 |
| EP | 165758 | 1/1991 |

OTHER PUBLICATIONS

Co-pending U.S. Appl. No. 12/236,772; Hydraulic Pump System with Reduced Cold Start Parasitic Loss, filed Sep. 24, 2008.

* cited by examiner

*Primary Examiner* — Thomas E Lazo
(74) *Attorney, Agent, or Firm* — Leonard Stewart

(57) ABSTRACT

The disclosure describes, in one aspect, a control system for charging an electro-hydraulic charging system. The control system including at least one sensor operatively coupled to an engine for sensing at least one engine parameter indicative of an operating status of the engine and a controller adapted to charge the charging system when the operating status of the engine is determined to be stable.

18 Claims, 4 Drawing Sheets

SYSTEM AND METHOD FOR CONTROLLING AN ELECTRO-HYDRAULIC CHARGING SYSTEM

TECHNICAL FIELD

This patent disclosure relates generally to brake systems, and more particularly to systems and methods for controlling an electro-hydraulic brake charging system.

BACKGROUND

Machines, such as passenger vehicles, trains, off-highway trucks, and mining vehicles, often employ hydraulic systems that provide functionality and control to various aspects of the machines. For example, some machines employ hydraulic braking systems to control driving speeds. These hydraulic braking system may include a fluid pressurizing pump or other types of parasitic loads that derive power from the machine's power source, namely, an engine. The braking system may generate an associate efficiency loss for the engine due to the pump and/or other parasitic loads.

One problem associated with this type of hydraulic arrangement involves starting of the machine when temperatures are low and/or altitudes are high, especially when the engine is also used to provide power to the other parasitic loads. There are known systems that include control systems associated with the operation of parasitic loads driven by an engine as the power source. For example, U.S. Pat. No. 6,920,387 to Landes et al. (hereinafter "'387") provides a control system for determining the net power output of an engine associated with a work machine or other vehicle wherein parasitic loads encountered during engine operation are taken into account. Nevertheless, '387 and other known systems do not disclose control of hydraulic systems based on engine speed for improved machine performance in low temperatures and/or high altitudes.

The present disclosure is directed to overcome one or more of the problems as set forth above.

SUMMARY

The disclosure describes, in one aspect, a control system for charging an electro-hydraulic charging system. The control system includes at least one sensor operatively coupled to an engine for sensing at least one engine parameter indicative of an operating status of the engine and a controller adapted to charge the charging system when the operating status of the engine is determined to be stable.

In another aspect, the disclosure describes a method for charging an electro-hydraulic charging system. The method includes receiving a signal indicative of an operating status of an engine from at least one sensor operatively coupled to the engine and charging the charging system when the operating status of the engine is determined to be stable.

BRIEF DESCRIPTION OF THE DRAWING(S)

DETAILED DESCRIPTION

Figure 1:
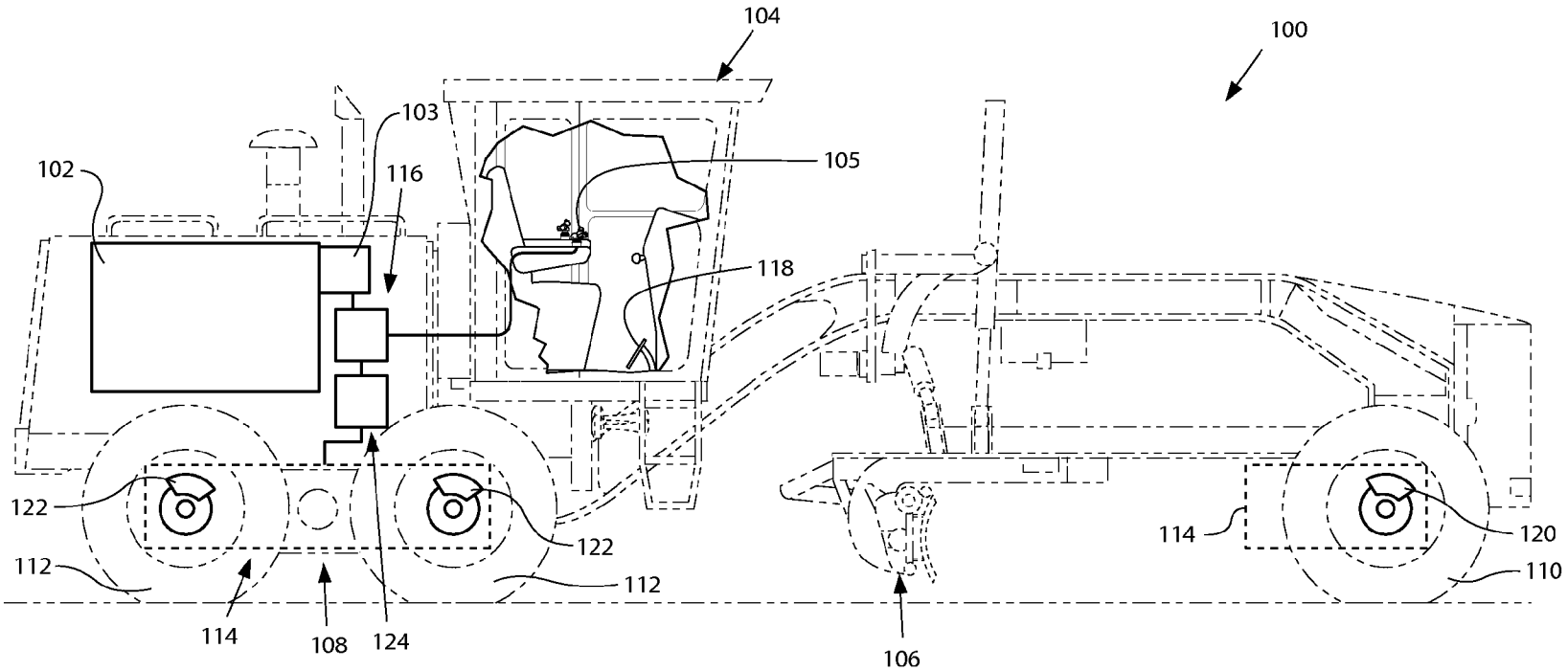
FIG. 1 is a diagrammatic side elevational view of a machine in accordance with an exemplary embodiment of the present disclosure.

This disclosure relates to systems and methods for controlling an electro-hydraulic charging system. An exemplary embodiment of a machine 100 is generally shown in FIG. 1. The machine 100 may be a mobile vehicle that performs some type of operation associated with an industry such as mining, construction, farming, transportation, or any other industry known in the art. For example, the machine 100 may be a motor grader, as depicted in FIG. 1, a wheel loader, a backhoe, an excavator, scraper, an off-highway truck, a passenger vehicle, or any other vehicle or machine 100 known in the art.

In the illustrated embodiment, the machine 100 includes a power source such as an engine 102, an operator station or cab 104 containing controls necessary to operate the machine 100, such as, for example, input devices 105 for propelling the machine 100 and other machine components, and a work tool or implement 106, such as, for example, a blade for moving earth. The input devices 105 may include one or more devices embodied as a joystick disposed within the cab 104 and may be adapted to receive input from the operator indicative of a desired work tool 106 or machine 100 movement.

The engine 102 may power a drive system 108 that may include front wheels 110 and rear wheels 112 adapted to support the machine 100. The wheels 110, 112 may be adapted for steering and maneuvering the machine 100 and for propelling the machine 100 in forward and reverse directions. In the illustrated embodiment, the drive system 108 includes a set of dual rear wheels 112, two wheels on each side the machine 100, and a set of front wheels 110, one on each side of the machine 100 (only one side shown).

The power source 102 may embody an engine such as, for example, a diesel engine, a gasoline engine, a gaseous fuel-powered engine, or any other type of combustion engine known in the art. It is contemplated that the power source 102 may alternatively embody a non-combustion source of power (not shown) such as, for example, a fuel cell, a power storage device, or another suitable source of power. The power source 102 may produce a mechanical or electrical power output that may be converted to hydraulic power.

One or more sensors 103 may be coupled to the power source 102 to sense an operational parameter of the power source 102 indicative of an operating status of the power source 102. In the illustrated embodiment, the one or more sensors 103 embody a speed sensor for sensing or receiving signals indicative of engine speed. Engine speed sensors 103 are well known and are commonly used to measure engine output speed. Any suitable engine speed sensors may be used without departing from the scope of this disclosure, such as, for example, Hall effect sensors, tachometers, etc.

The machine 100 further includes a braking system 114 operatively connected to a control system 116 and adapted to retard movement of the machine 100 or decelerate the machine 100 when the machine 100 is in motion. The control system 116 is operatively connected to the engine 102, the braking system 114, and the cab 104 and receives signals, for example, from the sensors 103 and the input devices 105 associated with the cab 104 to monitor and determine, for example, the output power of the engine 102 and to provide appropriate output signals to various systems for controlling the movement of the machine 100 and controlling the movement of the work tool 106, or for accomplishing various other functions and tasks.

The braking system 114 may be associated with the front wheels 110 and the rear wheels 112 and may be operable from other input devices, such as, for example, a brake pedal 118 within the cab 104. The braking system 114 may be hydraulically driven. The braking system 114 may include, for example, front brakes 120 and rear brakes 122. The front brakes 120 and rear brakes 122 may, respectively, be operatively associated with the front wheels 110 and rear wheels 112 to selectively retard or decelerate movement of the machine 100.

In some embodiments, the front and rear brakes 120, 122 may each include a hydraulic pressure-actuated wheel brake, such as, for example, a disk brake or a drum brake that is disposed intermediate to the wheels 110, 112 and a final drive assembly (not shown) of the machine 100. When actuated, pressurized fluid within the brakes 120, 122 increases the rolling friction of the machine 100 and thus retards the movement of the machine 100. The brakes 120, 122 may be operated in a known manner, such as, for example, by the brake pedal 118 disposed within the cab 104 of the machine 100. The brake pedal 118 may be associated with the brakes 120, 122 for manual control of the brakes 120, 122. As an operator depresses the brake pedal 118 along a braking range, pressurized fluid may be directed to the brakes 120, 122 such that a degree of brake pedal 118 depression proportionally controls a flow of pressurized fluid that is supplied to the brakes 120, 122.

The braking system 114 further includes a charging system 124 associated with at least one of the front brakes 120 or the rear brakes 122. The charging system 124 may include a plurality of fluid components and electrical components operatively connected to control the braking capacity of the braking system 114 and, as a result, control the braking capacity of the machine 100. In the illustrated embodiment, the charging system 124 is operatively connected to the control system 116 to regulate the flow of pressurized fluid directed to the brakes 120, 122. In some embodiments, the charging system 124 may be adapted to drive other integrated hydraulic systems, such as, for example, a cooling system 125, shown in FIG. 2, which may operate from a common fluid source. The fluid components and electrical components may cooperate to control the braking and cooling capacities of the machine 100.

Figure 2:
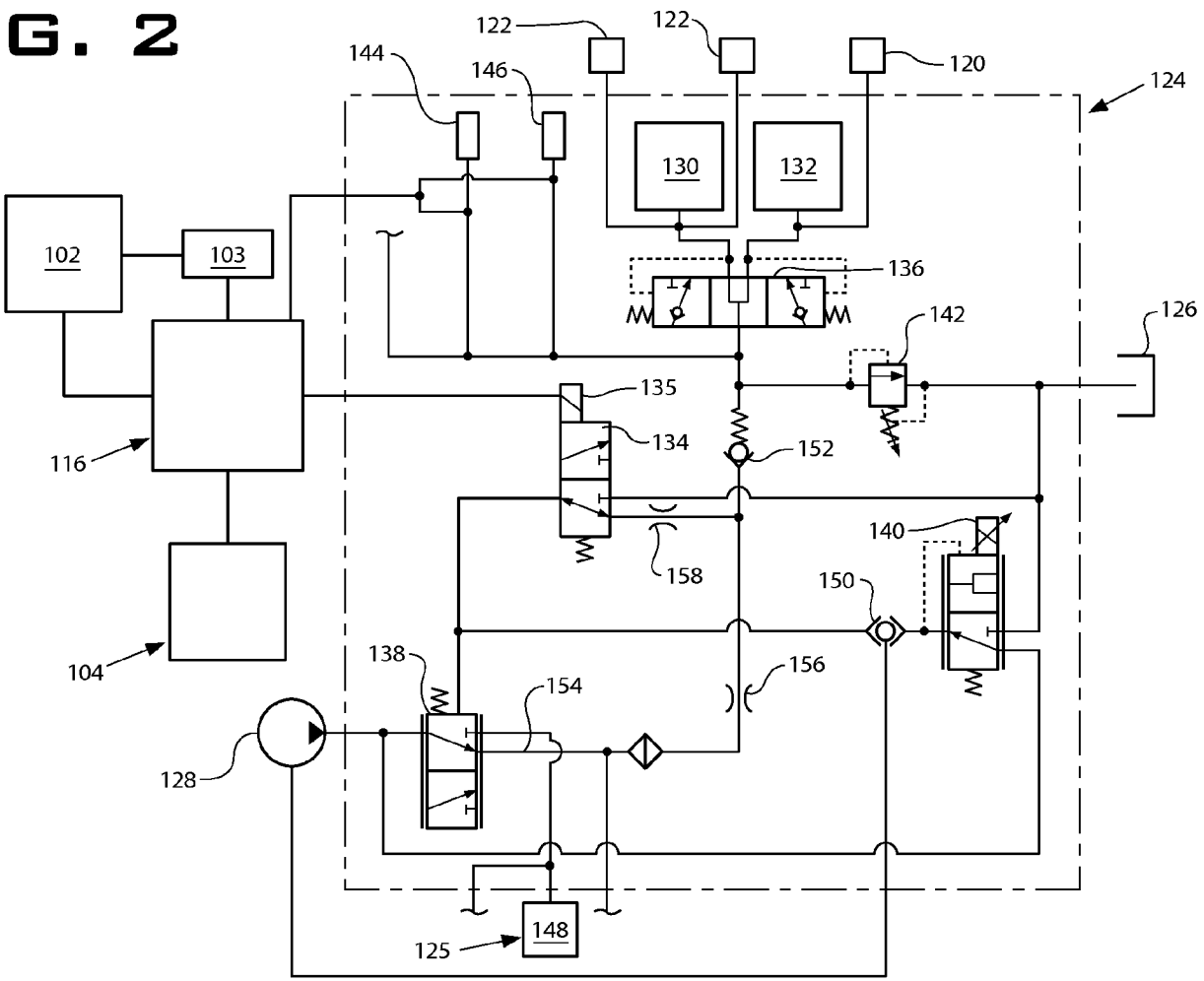
FIG. 2 is a schematic diagram of hydraulic circuit for the machine of FIG. 1 in accordance with an exemplary embodiment of the present disclosure.

Referring to FIG. 2, in the illustrated embodiment the charging system 124 includes a fluid reservoir or tank 126 for holding a supply of fluid, a fluid source or pump 128 adapted to pressurize fluid drawn from the tank 126, and one or more accumulators 130, 132 adapted to hold a supply of pressurized fluid at a desired pressure. In some embodiments, the charging system 124 may include one or more valves adapted to control a volume of pressure within the charging system 124. In the illustrated embodiment, the one or more valves include a brake charging valve 134 and an inverse shuttle valve 136.

It is contemplated that the one or more valves may include only the brake charging valve 134 for controlling pressure volume without the inverse shuttle valve 136. In embodiments including the integrated cooling system 125, the one or more valves further include a priority valve 138 and a fan control valve 140. In those embodiments, the functions of the cooling system 125 and the braking system 114 are integrated into one subsystem supplied by the pump 128. In some embodiments, the one or more valves further include a relief valve 142.

The charging system 124 is adapted to draw fluid from and return fluid to the tank 126. The tank 126 may be adapted to hold a supply of fluid. For example, the tank 126 may constitute a low-pressure reservoir adapted to hold the supply of fluid. The fluid may include, for example, a dedicated hydraulic oil, an engine lubrication oil, a transmission lubrication oil, or any other fluid known in the art. One or more hydraulic systems within the machine 100 may draw fluid from and return fluid to the tank 126.

The pump 128 is in fluid communication with the brakes 120, 122 through brake control valves (not shown) disposed between the brakes 120, 122 and the accumulators 130, 132. In some embodiments, the pump 128 may be driveably connected to a rotation output from the engine 102 of the machine 100, for example, by a counter shaft, a belt, an electric circuit, or in any other suitable manner. Alternatively, the pump 128 may be indirectly connected to the engine 102 by a torque converter, a reduction gearbox, or in any other suitable manner. It is also contemplated that the charging system 124 may be connected to multiple pumps 128 and multiple, separate fluid tanks 126, if desired, without departing from the scope of this disclosure.

In the illustrated embodiment, the pump 128 is adapted to provide pressurized fluid to the charging system 124. The pump 128 may be adapted to pressurize fluid drawn from the tank 126 and direct the pressurized fluid to the accumulators 130, 132. In the illustrated embodiment, the pump 128 embodies a variable displacement piston pump with load sensing capabilities, which permits the pump 128 to only operate or provide fluid flow when necessary, thus improving the efficiency of the machine 100. In some embodiments, the pump 128 may embody a fixed displacement pump adapted to produce a flow of pressurized fluid proportional to a rotational input speed. The pump 128 may be directly driven by an electric motor (not shown). The pump 128 may or may not be a fixed delivery pump, that is, a pump that delivers a constant flow rate of pressurized fluid per input revolution.

The brake charging valve 134, the one or more accumulators 130, 132, and the brake control valves (not shown) may be associated with the brakes 120, 122 and adapted to regulate the flow of pressurized fluid to the brakes 120, 122 to provide desired fluid to decelerate or stop the machine 100. Each accumulator 130, 132 may be fluidly connected to the associated brake 120, 122. The accumulators 130, 132 may be fluidly associated with the front brakes 120 and the rear brakes 122 through the brake pedal 118. The accumulators 130, 132 may be selectively filled with pressurized fluid via the brake charging valve 134 in anticipation of actuation of the brake pedal 118.

One or more sensors may be associated with the accumulators 130, 132 and may be adapted to sense and to communicate signals indicative of the pressure within or between the accumulators 130, 132. In the illustrated embodiment, the one or more sensors include two pressure sensors 144, 146 adapted to read the pressure representative of the combined pressure of the accumulators 130, 132.

The pressure of the accumulators 130, 132 may be controlled within a range of pressures. In some embodiments, a lower threshold defines a cut-in pressure level and an upper threshold defines a cut-out pressure level. The pressure of the accumulators 130, 132 are sensed by the pressure sensors 144, 146. In the illustrated embodiment, the control system 116 determines the pressure using pressure sensor arbitration. The pressure sensors 144, 146 may embody analog pressure sensors or pulse width modulation (PWM) pressure sensors. Pressure sensor arbitration may include reading the pressure when the pressure is equal to a minimum value read from the pressure sensors 144, 146.

The accumulators 130, 132 may be adapted to hold a supply of pressurized fluid at a desired pressure and to provide the desired fluid to slow, decelerate, or stop movement of the machine 100. For example, the accumulators 130, 132 may be maintained above a predetermined threshold to provide brake pressure when desired by the operator. In other words, the accumulator 130, 132 is adapted to store fluid pressure for brake control. That is, the charging system 124 may be adapted to maintain a fluid level in the accumulators 130, 132 at a substantially constant level, for example, at a fully-charged level. The relief valve 142 may protect the accumulators 130, 132 from being over charged or over-pressurized.

The brake control valve (not shown) may be selectively actuated in response to operator manipulation of the brake pedal 118 to either direct pressurized fluid from accumulators 130, 132 to the brakes 120, 122, which causes deceleration of the machine 100, or selectively actuated to drain the pressurized fluid from the brakes 120, 122 to the tank 126, thereby stopping the deceleration of the machine 100. When braking, the fluid in the accumulators 130, 132 may be gradually expended until the volume or pressure falls below a threshold, such as, for example, the cut-in threshold.

The brake charging valve 134, disposed between the pump 128 and the accumulators 130, 132, may be adapted to provide pressure from the pump 128 to the charging system 124 such that the fluid pressure of the accumulators 130, 132 is maintained at a substantially constant level during normal operating conditions. The brake charging valve 134 may include a solenoid 135 and may be electrically driven to direct fluid to the inverse shuttle valve 138. The inverse shuttle valve 138 is adapted to proportion the flow of fluid to the accumulators 130, 132.

The inverse shuttle valve 138 is piloted by the pressure between the accumulators 130, 132. The accumulator 130, 132 with the higher pressure will bias the inverse shuttle 138 to provide fluid flow to the accumulator 130, 132 with the lower pressure such that the accumulators 130, 132 are pressurized or charged evenly. If, for example, one of the accumulators 130, 132 fails, the pressure of the other accumulator 130, 132 will shift the inverse shuttle 138 to protect the non-failing accumulator 130, 132 from draining down. The non-failing accumulator 130, 132 is then used to meet the braking requirements of the machine 100.

In embodiments including the integrated cooling system 125, the priority valve 138 may be adapted to provide fluid flow to the accumulators 130, 132 and to the cooling system 125. Nevertheless, the priority valve 138 ensures that pressure is continuously available to the accumulators 130, 132 for brake charging, thus ensuring that charging the accumulators 130, 132 has priority over the cooling system 125. In other words, the priority valve 138 may be adapted to direct fluid to the accumulators 130, 132 anytime there is a fluid demand in any of the accumulators 130, 132, such as, for example, when fluid is consumed by the brakes 120, 122, and regardless of demand at the cooling system 125.

The cooling system 125 may include an electro-hydraulic demand fan 148 for providing the amount of cooling or airflow required by the machine 100, namely, the amount of cooling required by the engine 102. The fan 148 may be adapted to rotate in a first direction, which may drive the fan 148 in an air-pushing direction, and to rotate in a second direction, which may drive the fan in an air-drawing direction. The fan control valve 140 may be a solenoid driven valve that controls the demand fan 148. The control system 116 may control the fan control valve 140. The control system 116 may receive various temperature inputs to determine the amount of cooling required and to send commands to provide the amount of current necessary to the fan control valve 140 to provide a corresponding pressure command for driving fan speeds. Fan speeds may be driven by fan motors (not shown).

The control system 116 may include one or more control modules. The control system 116 may be in communication with the engine speed sensor 103 and the pressure sensors 144, 146. The control system 116 evaluates signals from the sensors 103, 144, 146 and uses the signals to generate control signals for electrically actuating the brake charging valve 134. In the illustrated embodiment, the control system maintains pressure in the brake accumulators 130, 132 by reading pressure from sensors 103, 144, 146 and activating the solenoid 135 of the brake charging valve 134. The control system may monitor the overall pressure of the braking system 114 and report the brake status to the operator and other systems. By controlling the brake charging valve 134, the control system controls the input fluid flow to the accumulators 130, 132.

The control system 116 may control fluid flow based upon the signal from the pressure sensors 144, 146. The pressure sensors 144, 146 may communicate a signal when the pressure in the accumulators 130, 132 drops below the cut-in level. Based on the signals from pressure sensors 144, 146, the control system 116 may output a command signal to the brake charging valve 134 to increase the fluid flow through the inverse shuttle valve 136 to the accumulators 130, 132. If, for example, the pressure signal is indicative of a pressure that is above the cut-out level, the control system 116 may output a command signal to the brake charging valve to shut off fluid flow to the accumulators 130, 132 and to direct fluid flow to the tank 126 instead.

The control system 116 may control fluid flow based upon a signal from the engine speed sensor 103. For example, based on the signal from the engine speed sensor 103 indicative of an engine speed relative to an engine speed threshold, the control system 116 may output a command signal to the brake charging valve 134 to increase the fluid flow through the inverse shuttle valve 136 to the accumulators 130, 132, or to shut-off the fluid flow through the inverse shuttle valve 136 to the accumulators 130, 132 and to direct the fluid flow instead to the tank 126. Directing the fluid flow to the tank 126 requires less pressurized fluid, which, therefore, reduces the load on the engine 102. In other words, by not charging the accumulators with pressurized fluid, the load on the engine 102 is reduced.

The control system 116 may further include memory. The memory may store one or more routines executable by the processor, which could be software programs, for controlling the charging system 124. In addition, the memory may store pre-established values or data used to determine a desired fluid flow from the pump 128 to operate the cooling system 125 at a desired fan speed and to provide a desired pressure to the charging system 124 for charging the accumulators 130, 132.

In some embodiments, the machine 100 includes an alarm system (not shown) for warning the operator that the charging system 124 is not maintaining sufficient pressure to adequately control the braking capacity of the machine 100, that is, a current brake charge status. The alarm system may generate an electrical or mechanical signal that may be communicated to the control system 116 that may consequently activate a visual, audible, or kinesthetic warning signal, such as, for example, a lamp, a warning light, a seat vibration, or any suitable alarm. The alarm system may warn the operator when the operator attempts to cause machine 100 movement, such as, for example, releasing a park brake (not shown) or shifting the machine 100 into gear, prior to the brake charge system being charged (e.g. at or below cut-in pressure level threshold in accumulators 130, 132).

The alarm system may also detect when fluid pressure being directed to the accumulators 130, 132 is below a predetermined or preset limit. For example, when the fluid pressure is below the cut-in level, the control system 116 activates a warning light or alarm disposed within the operator station and alerts the operator of the low pressure. In one embodiment, the alarm system may sense a fluid pressure between the accumulators 130, 132. In another embodiment, the alarm system may be adapted to measure the fluid pressure within each of the accumulators 130, 132 directly. In another embodiment, the alarm system may be adapted to measure the combined fluid pressure of the accumulators 130, 132.

When the fluid pressure is below the limit, the control system 116 may be signaled to direct the fluid flow from the pump 128 to the accumulators 130, 132 to increase the pressure in the accumulators 130, 132. Alternatively, or additionally, such as, for example, for embodiments including variable displacement pumps, when the fluid pressure is below the limit, the control system 116 may be signaled to electrically actuate the solenoid 135 to send a pressure signal to the pump 128 to increase fluid flow to the accumulators 130, 132, which increases the pressure in the accumulators 130, 132.

The charging system 124 operates in either a charging state or a non-charging state. In the charging state, the brake charging valve 134 is non-actuated, which means that the solenoid 135 is de-energized to allow pressurized flow to charge the accumulators 130, 132. In the illustrated embodiment, the brake charging valve 134 is spring-biased in the charging state. In the charging state, the pump 128 is in fluid communication with the accumulators 130, 132 to allow pressurized fluid to flow into the accumulators 130, 132. When this occurs, pressurized fluid is permitted to flow to the accumulators 130, 132 to charge the braking system 114.

In the non-charging state, the brake charging valve 134 is electrically actuated, which means the solenoid 135 of the brake charging valve 134 is energized. In the non-charging state, the brake charging valve 134 is shifted to allow the pump 128 to be in fluid communication with the tank 126 (i.e. to the low pressure reservoir) and to permit fluid to flow to the tank 126 instead of flowing to the accumulators 130, 132. In some embodiments, such as, for example, those including a variable placement pump, in the non-charging state, the brake charging valve 134 is shifted to allow a pressure signal to be in fluid communication with the tank 126, which causes the pump 128 to go to a minimum flow state, instead of providing flow to the accumulators 130, 132.

The control system 116 controls the charging system 124 to improve the performance of the machine 100. In the illustrated embodiment, the control system 116 reads the pressure sensors 144, 146 to determine the pressure of the accumulators 130, 132. If the pressure of the accumulators 130, 132 is at or below the cut-in pressure level, the control system 116 will send a command to de-energize the solenoid 135. The brake charging valve 134 will shift from a first position to a second position to allow pressurized fluid to flow to a load sense resolver 150. The load sense resolver 150 provides a signal to the pump 128 that is indicative of the pressure flow required to sufficiently charge the accumulator 130, 132 (i.e. a charge pressure signal).

Accordingly, the pump 128 will supply the fluid flow to meet the pressure requirement indicated by the load sense signal. The accumulator 130, 132 with the highest pressure will bias the inverse shuttle valve 136 to allow the fluid flow to charge the accumulator 130, 132 with the lowest pressure. Once the accumulator 130, 132 reaches the cut-out pressure level, the control system 116 will electrically signal the solenoid 135 of the brake charge valve 134 to energize. The brake charge valve 134 returns to the first position and consequently permits the fluid flow within the charging system 124 to flow through the brake charging valve 134 to the tank 126. A check valve 152 is disposed between the brake charge valve 134, and the accumulators 130, 132 to prevent pressure between the accumulators 130, 132 from feeding back into the brake charge valve 134.

In embodiments including the integrated cooling system 125, the control system 116 controls the fan control valve 140 to send a signal indicative of a fan control pressure to the load sense resolver 150. The load sense resolver 150 compares the fan control pressure signal to the charge pressure signal and allows the highest of the two pressure signals to be sent to the pump 128. The control system 116 may receive temperature signal inputs from one or more temperature sensors (not shown) to determine a cooling requirement and to control the speed of the fan 148. The fan control pressure corresponds with the fan speed necessary to meet the cooling requirement. The fan speed may be set between a minimum and a maximum fan speed value.

When the charging system 124 is in the charging state, the charge pressure signal will bias the load sense resolver 150 and overcome the fan control pressure signal and send the charge pressure signal to the pump 128. Accordingly, the priority valve 138 will shift to give priority flow from the pump 128 to charging the accumulators 130, 132 through fluid channel 154. The fluid flow for charging the accumulators passes through one or more orifices 156, 158 to control the rate at which the accumulators 130, 132 charge or to dampen noise in the hydraulic circuit caused by pressure spikes. Any excess fluid flow is allowed to go to the fan 148.

When the charging system 124 is in the non-charging state, the load sense resolver 150 will shift to send the fan control pressure signal to the pump 128 and the priority valve 138 will shift to allow fluid flow to the fan 148. The check valve 152 prevents pressure from feeding back into the brake charge valve 134, the priority valve 138, and the fan control valve 140.

INDUSTRIAL APPLICABILITY

The industrial applicably of the systems and methods for controlling a charging system described herein will be readily appreciated from the foregoing discussion. Although the machine 100 is shown as a motor grader, the machine 100 may be any type of machine 100 that performs at least one operation associated with, for example, mining, construction, and other industrial applications. The machine 100 may also be associated with non-industrial uses and environments, such as, for example, cranes, earthmoving vehicles, backhoes, and/or material handling equipment. Moreover, the systems and methods described herein can be adapted to a large variety of machines and tasks. For example, backhoe loaders, compactors, feller bunchers, forest machines, industrial loaders, skid steer loaders, wheel loaders, scrapers, and many other machines can benefit from the systems and methods described.

Figure 3:
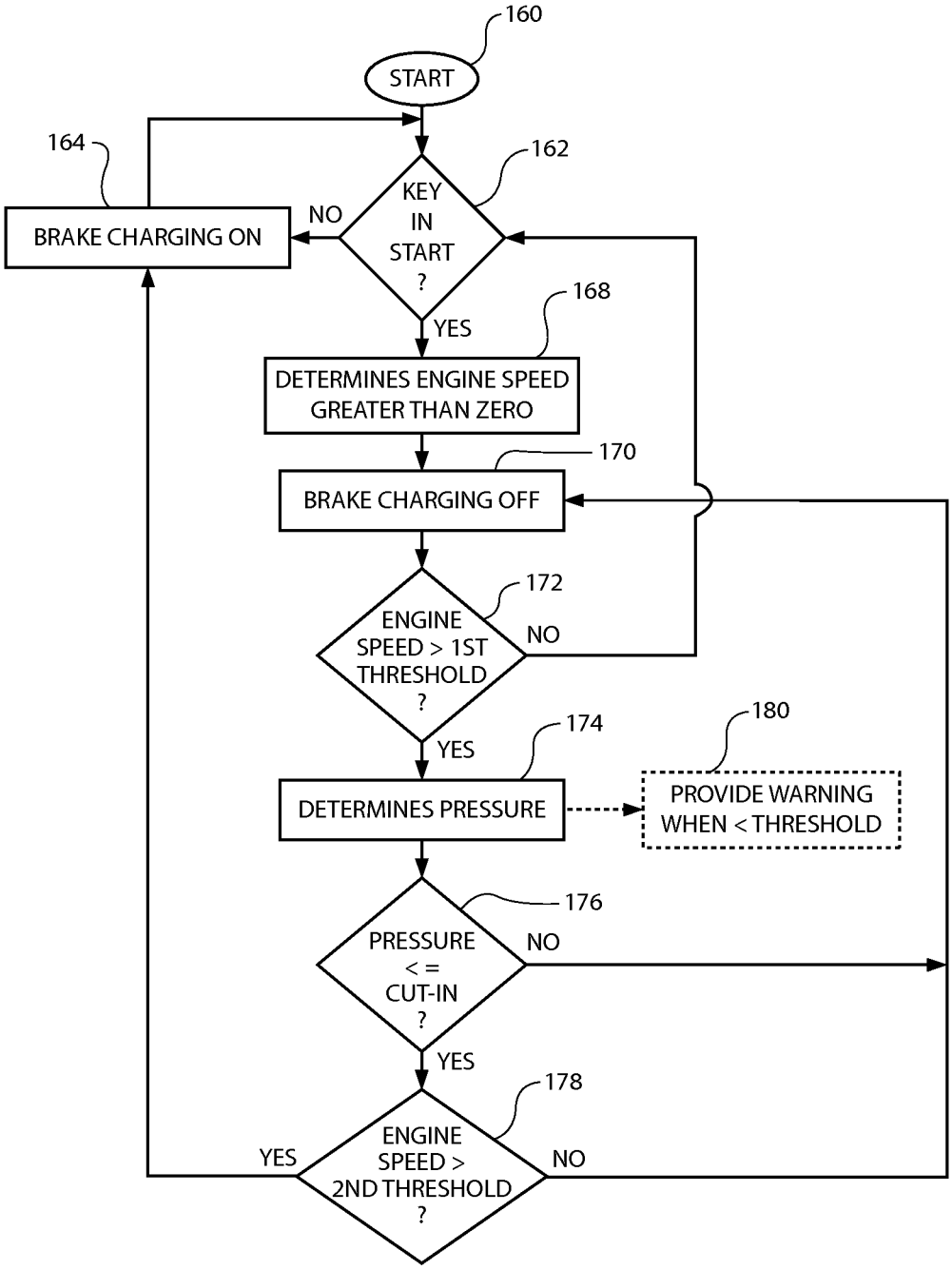
FIG. 3 is a flow diagram illustrating one embodiment of a brake charging process in accordance with an exemplary embodiment of the present disclosure.

As discussed, one exemplary machine 100 suited to the disclosure is the motor grader. FIG. 3 illustrates a flow chart of an exemplary embodiment of a brake charging process (160) for the charging system 124 that may be performed by the control system 116 and/or other components of the machine 100. As mentioned above, the control system 116 may control the charging system 124 based on an engine speed signal received from the engine speed sensor 103 to reduce the parasitic load on the engine 102, which is the load that typically results from the pump 128 charging the charging system 124. Thus, controlling the charging system 124 based on the engine speed signal allows electro-hydraulic control of the braking system 114 for improved machine 100 performance, particularly in low temperature environments and/or at high altitudes.

When the machine 100 is off and the pump 128 is not operating, the charging system 124 may be biased to be charged once the pump 128 is operating. For example, the brake charging valve 134 may be non-actuated or de-energized to allow pressurized flow to charge the accumulators 130, 132 in anticipation of when the pump 128 is operating. Before an engine start event, the control system 116 may monitor and control the behavior of the solenoid 135 of the brake charging valve 134. For example, when a suitable engine-starting device embodied for example as a key is turned to an on position, but the engine 102 is not yet starting or cranking, the solenoid 135 is caused to de-energize and the brake charging valve 134 is biased towards charging or pressurizing the accumulators 130, 132. For simplification purposes, the engine-starting device will be referred to as the key in the description and the figures.

In the illustrated embodiment, the control system 116 is adapted to determine whether the key is in a start position (Step 162). During the engine start event, when the key is in the start position (Step 162: YES), under certain conditions the control system 116 may cause the solenoid 135 of brake charging valve 134 to energize, which turns off brake charging by directing fluid flow to the tank 126 instead of to the accumulators 130, 132, and therefore avoids parasitic drain on the engine 102 during cranking. In the illustrated embodiment, if the key is in the start position (Step 162, YES), the control system 116 causes the solenoid 135 of the brake charging valve to energize, which turns off brake charging (Step 164).

If the key is not in the start position (Step 162: NO), the control system 116 is further adapted to determine whether the key is in a run position (Step 166). If the key is not in the run position (Step 166: NO), the control system 116 causes the solenoid 135 to de-energize, which turns brake charging on (Step 168). In other words, if the key is not in the start position and not in the run position, then the engine 102 has not completed or concluded a successful start event and therefore the brake charging valve 134 returns to being biased towards charging or pressurizing the accumulators 130, 132, as is discussed above.

If the key is in the run position (Step 166: YES), the control system 116 monitors the engine speed by sensing or receiving engine speed signals (Step 170). When the key is in the run position (Step 166: YES), the engine start event has successfully concluded and the engine 102 under certain conditions may be considered to be running, that is, the engine speed is greater than zero (172: YES). If the engine speed is less than or equal to zero (172: NO), the control system 116 causes the solenoid 135 to de-energize, which turns brake charging on (Step 168). In other words, if the engine speed is less than or equal to zero (172: NO), the engine 102 may not have completed or concluded a successful start event and therefore the brake charging valve 134 returns to being biased towards charging or pressurizing the accumulators 130, 132, as is discussed above.

If the engine speed is greater than zero (Step 172: YES), the control system 116 is adapted to determine if the engine speed is above a first engine speed threshold (Step 174). If the engine speed is less than the first threshold (Step 174: NO), the engine 102 is considered to be operating in an unstable condition and the control system 116 causes the solenoid 135 to energize, which turns brake charging off (Step 175). If, however, the engine speed is greater than the first threshold (Step 174: YES), the control system 116 is further adapted to determine or sense the pressure of the accumulators 130, 132 (Step 176). Additionally, or alternatively, if the engine speed is determined to be above the first threshold (Step 174, YES), but the pressure of the accumulators 130, 132 is determined to be below a pressure threshold sufficiently low for providing a warning, as discussed in detail above, the control system 116 provides a warning signal (Step 177), which could be an audible, visual, or kinesthetic signal.

If the pressure is below the cut-in pressure level (Step 178: YES), the control system 116 causes the solenoid 135 to de-energize, which turns brake charging on (Step 180). The control system 116 continues to monitor the engine speed to determine if the engine speed is greater than or equal to a second engine speed threshold (Step 182). If the engine speed is greater than or equal to the second threshold (Step 182: YES), the control system 116 continues to cause the solenoid 135 of the brake charging valve 134 to de-energize, turning brake charging on, as long as the pressure is less than the cut-out pressure level (Step 184: NO). If, however, the pressure is greater than or equal to the cut-out pressure level (Step 184: YES), the control system 116 causes the solenoid 135 of the brake charging valve 134 to energize, which turns off brake charging (Step 186).

In other words, if the pressure of the accumulators 130, 132 is below a brake charging pressure threshold (the cut-in pressure level) and the engine speed is within an engine stable range (greater than the first and second engine speed thresholds), the control system 116 turns on brake charging. Thus, the parasitic load on the engine 102 is increased only when the engine 102 is considered to be operating or running in a stable condition. Nevertheless, if the engine speed is within the stable range, but the pressure of the accumulators 130, 132 is above the cut-out pressure level threshold, which means that the accumulators 130, 132 are sufficiently charged, the control system 116 causes the solenoid 135 to energize, which turns brake charging off.

The control system 116 is also adapted to monitor and control the behavior of the solenoid 135 of the brake charging valve 134 when the engine speed falls below the second engine speed threshold, which is also indicative of the engine 102 operating in the unstable condition. When the engine 102 is determined to be operating in the unstable condition, brake charging may be turned off to allow the engine 102 to recover or return to a more stable operating condition. In the illustrated embodiment, if the engine speed is less than the second threshold (Step 182, NO), the control system 116 causes the solenoid 135 of the brake charging valve 134 to energize, which turns off brake charging (Step 175), and therefore reduces the parasitic load on the engine 102.

When the engine 102 is operating in the stable condition and the pressure is above the cut-in pressure level (Step 178: NO), the control system 116 is adapted to determine whether to turn brake charging on or to turn brake charging off based on whether the charging system 124 is currently being charged or not being charged (Step 188). In other words, if the pressure is above the cut-in pressure level (Step 178: NO) and brake charging is on (Step 188: YES), the control system 116 will continue to cause the solenoid 135 to be de-energized, that is, keep brake charging turned on (Step 180), until the engine speed is less than the second threshold (Step 182: NO) or until the pressure is greater than or equal to cut-out pressure level (Step 184: YES).

If, however, the pressure is above the cut-in pressure level (Step 178: NO) and brake charging is off (Step 188: NO), the control system 116 will continue to cause the solenoid 135 to be energized, that is, keep brake charging off (Step 186), until the pressure is below cut-in pressure level (Step 178: YES). It is also contemplated that in some alternative embodiments, the control system 116 is adapted to control the behavior of the solenoid 135 of the brake charging valve 134 only for a predetermined or predefined period of time. In other words, after an engine running timeout period, the control system 116 will no longer control brake charging based on engine speed signals.

Figure 4:
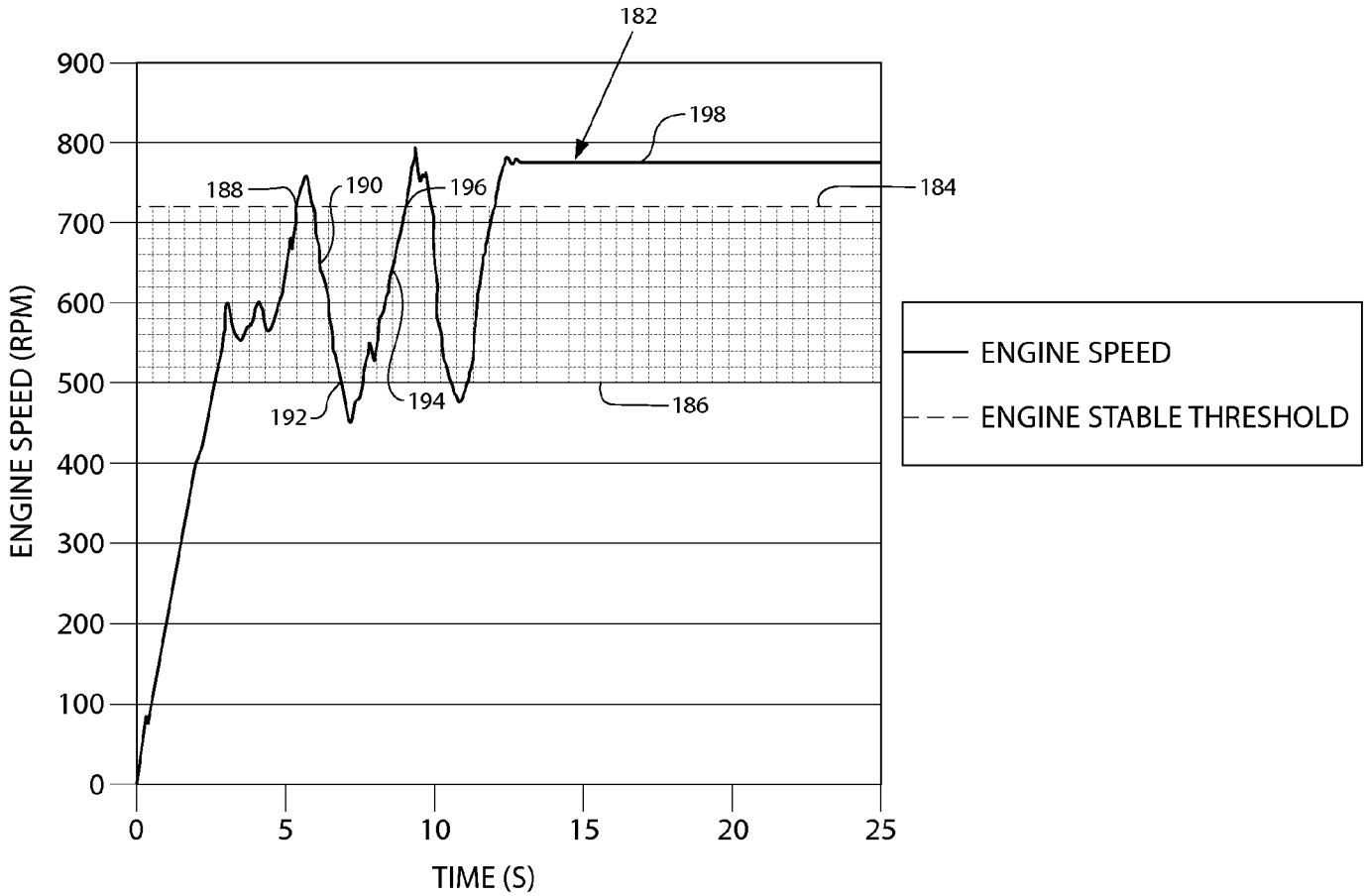
FIG. 4 is a series of curves illustrating control operations of one embodiment of the brake charging process in accordance with an exemplary embodiment of the present disclosure.

Referring to the curves in FIG. 4, which show typically how the illustrated embodiment of the control system 116 is adapted such that while the engine speed, generally shown at 200, is stable the previous operating status of the charging system 124 does not change, for example, between the first threshold 202 at approximately 700 RPM and the second threshold 204 at approximately 500 RPM. In other words, the previous command to energize or de-energize the solenoid 135 remains the same when the engine speed 200 is between the first 202 and second 204 thresholds. Note that FIG. 4 illustrates how the control system 116 causes the charging system 124 to charge the accumulators 130, 132 when the pressure of the accumulators 130, 132 is below the brake charging pressure threshold, that is, below the cut-in pressure level and above the cut-in pressure level but below the cut-out pressure level.

For example, when the engine speed 200 is greater than zero, brake charging is off until the engine speed 200 exceeds the first threshold 202 (at 206) where the control system 116 causes the solenoid 135 to de-energize and turn brake charging on. Brake charging remains on, for example, at 208, until the engine speed 200 is below the second threshold 204 (at 210) where the control system 116 causes the solenoid 135 to energize and turn brake charging off. Brake charging remains off, for example, at 212 until the engine speed 200 is above the first threshold 202 (at 214).

Accordingly, the control system 116 continues to control brake charging in the charging system 124 based on the engine speed 200 until the engine 102 is stable, such as, for example, at 216, when the engine speed 200 is continuously above the first threshold 202. In alternative embodiments, the control system 116 continues to control brake charging in the charging system 124 based on the engine speed 200 for a predetermined period of time, such as, for example, until after the engine 102 running timeout period is satisfied.

It will be appreciated that the foregoing description provides examples of the disclosed systems and methods. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A control system for charging an electro-hydraulic charging system, the control system comprising:

at least one sensor operatively coupled to an engine for sensing at least one parameter indicative of operating status of the engine; the at least one sensor is an engine speed sensor, the at least one parameter is engine speed;

a controller operatively coupled to the at least one sensor and adapted to:

charge the charging system when the operating status of the engine is determined to be stable, the operating status of the engine is determined to be stable when the engine speed is greater than a first engine speed threshold.

2. The control system of claim 1, wherein the operating status of the engine is determined to be stable when the engine speed has fallen below the first engine speed threshold and is greater than a second engine speed threshold.

3. The control system of claim 2, wherein the controller is adapted to stop charging the charging system when the operating status of the engine is determined to be unstable and the operating status of the engine is determined to be unstable when the engine speed is less than the second engine speed threshold.

4. The control system of claim 1, wherein the charging system is adapted for charging an electro-hydraulic braking system.

5. The control system of claim 4 further comprising:

at least one sensor for sensing pressure and operatively connected to at least one accumulator in the charging system;

wherein the controller is adapted to charge the charging system when the pressure of the at least one accumulator is below a pressure threshold.

6. The control system of claim 5, wherein the charging system includes at least one valve having an electrically activated solenoid, the controller is adapted to control an operating state of the charging system by electrically activating the solenoid, and the operating state of the charging system includes a non-charging state and a charging state.

7. The control system of claim 6, wherein the valve directs fluid to flow to the at least one accumulator to be pressurized when the charging system is in the charging state and directs fluid to flow to a tank to prevent the at least one accumulator from being pressurized when the charging system is in the non-charging state.

8. The control system of claim 7, wherein the charging system further includes a cooling system having an electro hydraulic fan and at least one valve adapted to provide fluid flow to the at least one accumulator for pressurizing the at least one accumulator and to the fan for driving a fan speed.

9. A method for charging an electro-hydraulic charging system, the method comprising:

receiving a signal indicative of an operating status of an engine from at least one sensor operatively coupled to the engine, receiving the signal indicative of the operating status includes an engine speed sensor; and charging the charging system when the operating status of the engine is determined to be stable the operating status of the engine is determined to be stable when the engine speed is greater than a first engine speed threshold.

10. The method of claim 9, wherein the operating status of the engine is determined to be stable when the engine speed has fallen below the first engine speed threshold and is greater than a second engine speed threshold.

11. The method of claim 10, further comprising:

stopping charging of the charging system when the engine speed is less than the second engine speed threshold.

12. The method of claim 11, wherein charging the charging system includes charging an electro-hydraulic braking system.

13. The method of claim 12, further comprising:

receiving a signal indicative of a pressure from a pressure sensor operatively coupled to at least one accumulator; and charging the charging system when the pressure of the at least one accumulator is below a pressure threshold.

14. The method of claim 13, further comprising:

controlling an operating state of the charging system by electrically activating a solenoid of at least one valve, wherein the operating state of the charging system includes a non-charging state and a charging state.

15. The method of claim 14, further comprising:

controlling the valve to direct fluid flow to the at least one accumulator when the charging system is in the charging state thereby charging the at least one accumulator, and controlling the valve to direct fluid flow to a tank thereby preventing the at least one accumulator from being pressurized when the charging system is in the non-charging state.

16. A machine having a controller for reducing a load on an engine, the machine comprising:

an electro-hydraulic charging system operatively coupled to the engine;

and engine speed sensor operatively coupled to the engine;

a braking system operatively coupled to the charging system for controlling the braking of the machine;

at least one accumulator operatively coupled to the braking system;

at least one pressure sensor operatively coupled to the at least one accumulator;

at least one valve having an electrically activated solenoid, wherein the at least one valve is disposed between the at least one accumulator and a pump;

the controller adapted to:

sense pressure associated with the at least one accumulator;

sense engine speed associated with the engine;

determine if the pressure is below a pressure threshold; and deactivate the solenoid to allow pressurized fluid to flow to the at least one accumulator if the engine speed is greater than a threshold indicative of an engine stable condition.

17. The machine of claim 16, wherein the controller is further adapted to activate the solenoid to direct fluid flow to a tank if the engine speed is less than a threshold indicative of an engine non-stable condition.

18. The machine of claim 17, wherein the controller is adapted to maintain a current operating state of the charging system when the engine speed is between the engine stable condition threshold and the engine non-stable condition threshold, the current operating state defines a charging state when the engine speed is greater than the engine stable condition threshold and defines a non-charging state when the engine speed is less than the engine non-stable condition threshold.

* * * * *